US006516168B2

(12) United States Patent
Shiratori et al.

(10) Patent No.: US 6,516,168 B2
(45) Date of Patent: Feb. 4, 2003

(54) IMAGE FORMING APPARATUS, A CARTRIDGE AND DEVELOPER CONTAINER DETACHABLY MOUNTABLE THEREON, AND A DRIVING SOURCE FOR PROVIDING A FORCE FOR OPENING A SEALING MEMBER FOR REMOVABLY SEALING A DEVELOPER SUPPLYING OPENING

(75) Inventors: Tatsuya Shiratori, Yokohama (JP); Kazuhiko Kanno, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/725,804

(22) Filed: Nov. 30, 2000

(65) Prior Publication Data

US 2001/0005460 A1 Jun. 28, 2001

(30) Foreign Application Priority Data

Dec. 1, 1999 (JP) ..... 11-342341

(51) Int. Cl.[7] ..... G03G 15/08

(52) U.S. Cl. ..... 399/103; 399/102; 399/106; 399/262

(58) Field of Search ..... 222/DIG. 1; 399/27, 399/102, 103, 106, 258, 262

(56) References Cited

U.S. PATENT DOCUMENTS

| | | | | |
|---|---|---|---|---|
| 5,729,796 A | | 3/1998 | Miura et al. | 399/114 |
| 5,745,822 A | * | 4/1998 | Nishimura et al. | 399/106 |
| 5,768,658 A | | 6/1998 | Watanabe et al. | 399/111 |
| 5,815,644 A | | 9/1998 | Nishiuwatoko et al. | 399/113 |
| 5,870,655 A | | 2/1999 | Nishiuwatoko et al. | 399/111 |
| 5,893,006 A | | 4/1999 | Kanno et al. | 399/13 |
| 5,926,666 A | | 7/1999 | Miura et al. | 399/25 |
| 5,937,240 A | | 8/1999 | Kanno et al. | 399/111 |
| 5,940,657 A | | 8/1999 | Yokomori et al. | 399/119 |
| 5,950,049 A | | 9/1999 | Yokomori et al. | 399/119 |
| 6,070,029 A | | 5/2000 | Nishiuwatoko et al. | 399/111 |
| 6,072,969 A | | 6/2000 | Yokomori et al. | 399/119 |

* cited by examiner

*Primary Examiner*—Hoang Ngo
(74) *Attorney, Agent, or Firm*—Fitzpatrick, Cella, Harper & Scinto

(57) ABSTRACT

A cartridge detachably mountable to the main assembly of an image forming apparatus includes a developing frame provided with an opening; a developer carrying member in the opening to carry developer; a developer containing portion for storing developer, the developer containing portion supplying developer to the developing frame through the developer supplying opening; a sealing member for removably sealing the developer supplying opening; and a driving source substantially exclusive for providing the force for opening the sealing member.

22 Claims, 6 Drawing Sheets

IMAGE FORMING APPARATUS, A CARTRIDGE AND DEVELOPER CONTAINER DETACHABLY MOUNTABLE THEREON, AND A DRIVING SOURCE FOR PROVIDING A FORCE FOR OPENING A SEALING MEMBER FOR REMOVABLY SEALING A DEVELOPER SUPPLYING OPENING

FIELD OF THE INVENTION AND RELATED ART

The present invention relates to a cartridge, and an image forming apparatus in which the cartridge is detachably mountable.

An image forming apparatus is an apparatus which forms images on a piece of a recording medium with the use of an electrophotographic image formation process. Examples of an image forming apparatus are electrophotographic copying machines, electrophotographic printers (for example, LED printers, laser beam printers, and the like), electrophotographic facsimiles, and the like.

A cartridge is a such a cartridge that integrally comprises an image bearing member, and at least one component among a charging means, a cleaning means, and a developing means, and is rendered detachably mountable to the main assembly of an image forming apparatus.

The application of the present invention is not limited to a cartridge which comprises an image bearing member. In other words, the present invention is also applicable to a development cartridge which does not have an image bearing member, and instead has a developing device integral with a hopper in which toner is accumulated, and which is detachably mountable to the main assembly of an image forming apparatus, and is applicable to image forming apparatuses in which such a development cartridge is detachably mountable A conventional image forming apparatus which employs an electrophotographic image formation process employs a process cartridge system, according to which an electrophotographic photosensitive member, that is, an image bearing member, and one or a plurality of processing means which act on the electrophotographic image bearing member are integrated in the form of a cartridge detachably mountable to the main assembly of an image forming apparatus. With the employment of this process cartridge system, an image forming apparatus can be maintained by a user him/herself without relying on service personnel, remarkably improving operational efficiency. Thus, a process cartridge system has come to be widely used in the field of an image forming apparatus.

A process cartridge such as the one described above is provided with a photosensitive drum, which is an image bearing member, and a developing means for adhering developer (toner) to a latent image formed on the photosensitive drum. A developing means has a developing-means housing and a toner housing, which are connected to each other. The developing means housing holds a development roller which is a developer bearing member, and the like members. The toner housing is a developer holding portion which holds toner. Prior to the first time usage of a process cartridge, a developer outlet, which is an opening located in the joint between the toner housing and developing means housing, is sealed with a sealing member. Therefore, as a brand-new process cartridge is installed into the main assembly of an image forming apparatus to be used for the first time, the sealing member, which is sealing the opening of the toner housing, must be broken or removed. Thus, some process cartridges are equipped with an automatic sealing member removing apparatus, and some image forming apparatuses are known to be enabled to drive such an automatic sealing member removing apparatus of a process cartridge.

An automatic sealing member removing apparatus has the following problems. The occasion at which a user installs or removes a process cartridge into or from the main assembly of an image forming apparatus is not limited to when the currently used process cartridge must be replaced with a fresh one due to the expiration of its service life. For example, the same operation is carried out when a paper jam in the main assembly of an image forming apparatus must be taken care of. In recent years, the size of the main assembly of a laser beam image forming apparatus has been substantially reduced, and therefore, it is common practice to remove the process cartridge from the main assembly of the image forming apparatus before taking care of a paper jam in the main assembly of the image forming apparatus. The motor of the aforementioned automatic sealing member removing apparatus may be rotated to wind away a sealing member each time a process cartridge is installed into the main assembly of an image forming apparatus because there is the possibility that the cartridge being installed is a brand-new one. However, it is wasteful to carry out this sealing member opening operation when the sealing member of the process cartridge has been already wound away; for example, immediately after a paper jam has been taken care of, that is, when the user knows that the sealing member has been pulled away, and therefore is expecting that printing will start immediately. Thus, a user sometimes feels irritated with this wasteful down time during which the motor is turned on and rotates idly, that is, without winding away the sealing member, after a paper jam has been taken care of.

SUMMARY OF THE INVENTION

The primary object of the present invention is to provide a cartridge and an image forming apparatus which are capable of automatically sensing whether or not the sealing member for sealing the toner supply opening of the cartridge has been opened Another object of the present invention is to provide a cartridge and an image forming apparatus which do not repeat a sealing member opening operation when the sealing member has been opened.

Another object of the present invention is to provide a cartridge and an image forming apparatus, the power source of which for opening the sealing member is enabled to determine the actual amount of force necessary to open the sealing member.

Another object of the present invention is to provide a cartridge and an image forming apparatus which are provided with a mechanical power source substantially dedicated or substantially exclusive for providing the force for opening the sealing member.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the process cartridge and image forming apparatus in accordance with the present invention will be described in detail with reference to the appended drawings.

Embodiment 1

The cartridge in accordance with the present invention, and an image forming apparatus which employs the cartridge, in the first embodiment of the present invention, will be described with reference to the drawings.

Figure 6:
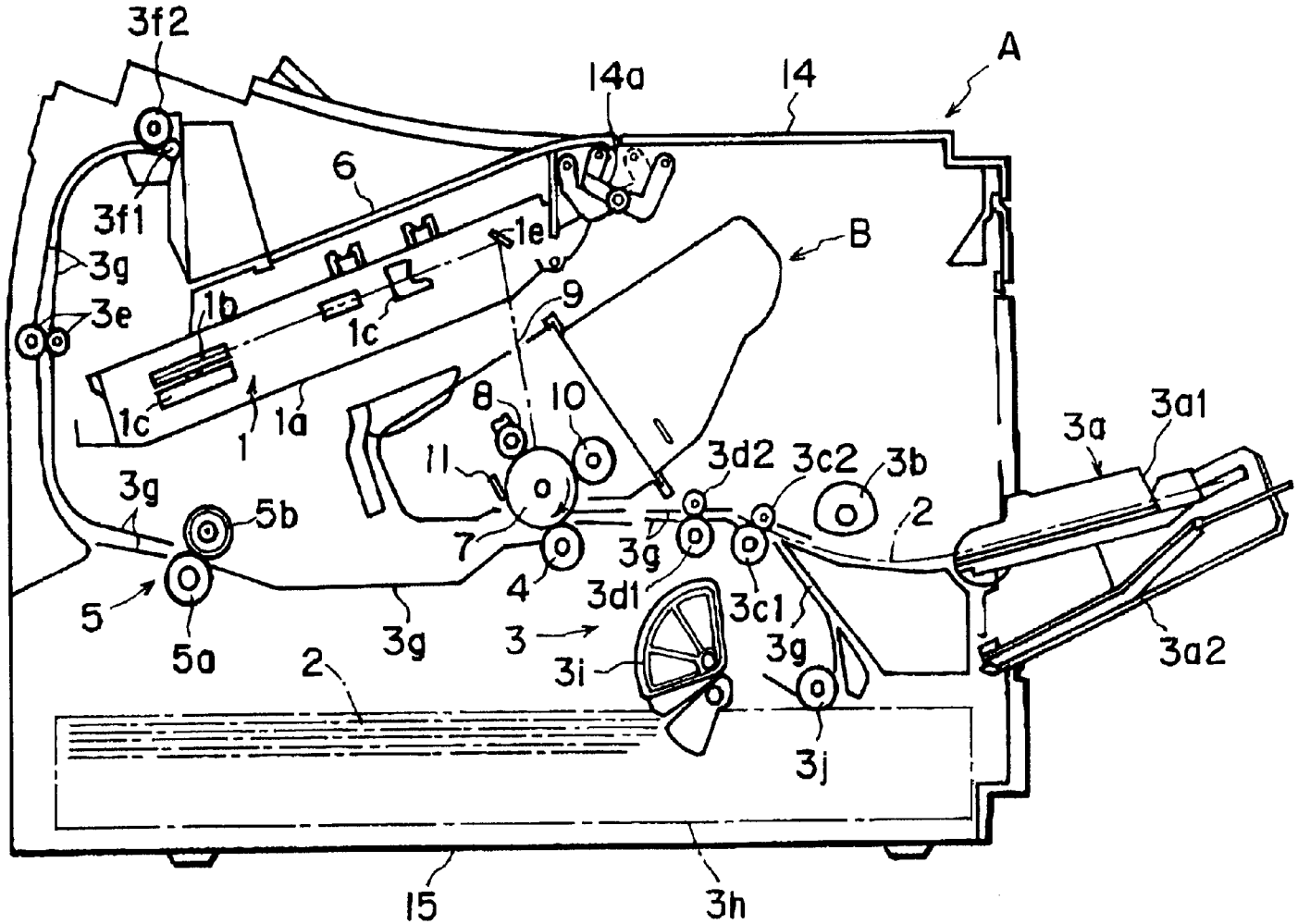
FIG. 6 is a vertical sectional view of an example of an image forming apparatus to which the present invention is applicable.
Figure 7:
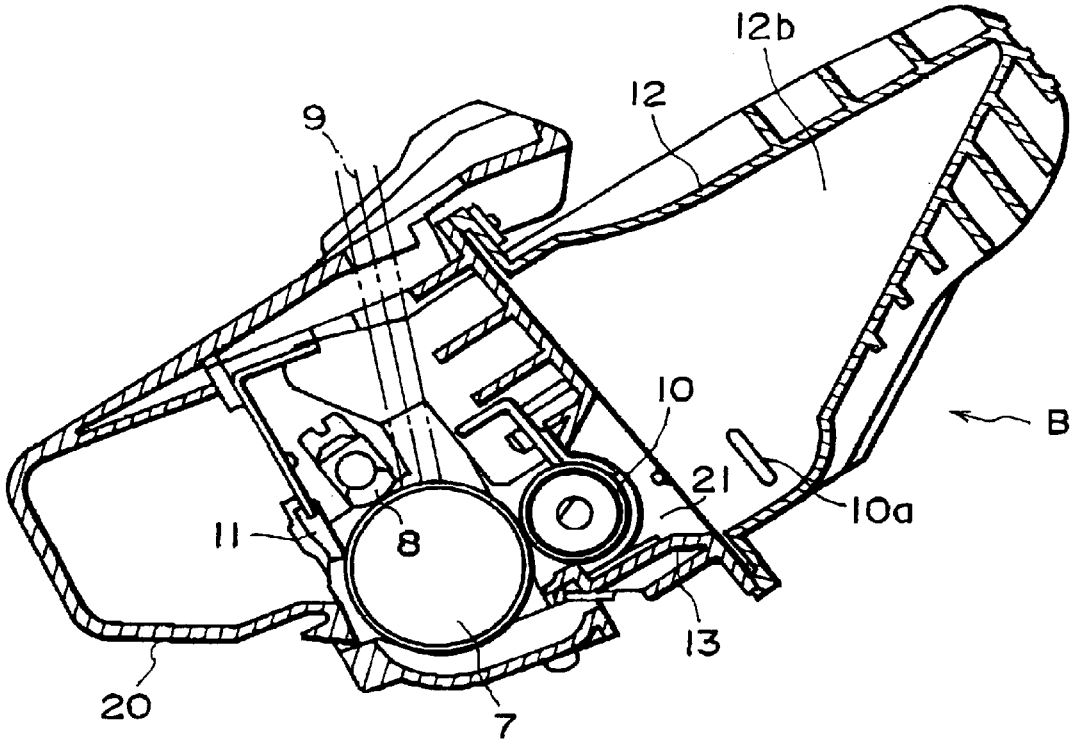
FIG. 7 is a vertical sectional view of a process cartridge, which shows the interior of the cartridge.

First, the general structure of the image forming apparatus will be described referring to FIG. 6. FIG. 6 is a drawing which shows the structure of the main assembly 15 of a laser beam printer, that is, an example of an image forming apparatus, in accordance with the present invention, and the process cartridge in accordance with the present invention in the main assembly 15. FIG. 7 is a drawing which shows the structure of the process cartridge.

Referring to FIG. 6, an image forming apparatus A forms a developer image (which hereinafter will be called a toner image) on a photosensitive drum 7, which is an electrophotographic photosensitive member, by exposing the photosensitive drum 7 to an optical image, in accordance with image information, projected from an optical system 1. While a toner image is formed, a piece of recording medium 2 is conveyed by a conveying means 3 in synchronism with toner image formation, and as the recording medium 2 is conveyed, the toner image formed on the photosensitive drum 7 is transferred onto the recording medium 2 by a transferring means 4 in the image forming portion of a process cartridge B. After the transferring of the toner image, the recording medium 2 is conveyed to a fixing means 5 comprising a pressure roller 5*a* and heat roller 5*b*. In the fixing means 5, the transferred toner image is fixed to the recording medium 2. Thereafter, the recording medium 2 is discharged to a delivery portion 6.

Image Forming Apparatus

Next, the structures of the various sections of the image forming apparatus A will be described with reference to FIG. 6.

Optical System

The optical system 1 is a system which projects to the photosensitive drum 7 an optical image in accordance with the image information read into the image forming apparatus from an external apparatus or the like. The optical unit la on the main apparatus side of an image forming apparatus contains an unillustrated laser diode, a polygon mirror 1*b*, a scanner motor 1*c*, a focusing lens 1*d*, and a deflection mirror 1*e*.

As an image signal is given from an external device or the like, the laser diode emits light in response to the image signal, and this light is projected as an image light to the polygon mirror 1*b*, which is being rotated at a high velocity by the scanner motor 1*c*. After being reflected by the polygon mirror 1*b*, the light is projected to the photosensitive drum 7 through the focusing lens 1*k* and the deflection mirror 1*e*, and selectively exposes the surface of the photosensitive drum 7.

Recording Medium Conveying Means

Next, the structure of the conveying means 3 for conveying the recording medium 2 will be described. In the case of the image forming apparatus in this embodiment, the recording medium 2 can be fed in two different manners: manually, or with the use of a cassette. In the case of the manual feeding of the recording medium 2, first, a plurality of sheets of the recording medium 2 are set in a sheet feeder tray 3*a*. As an image forming operation is started, the recording media 2 in the sheet feeder tray 3*a* is fed one by one into the image forming apparatus by a pickup roller 3*b*, being separated from the following sheets of recording medium by a pair of separation rollers 3*c*1 and 3*c*2, in such a manner that the leading edge of each recording medium 2 comes into contact with a pair of registration rollers 3*d*1 and 3*d*2.

The pair of registration rollers 3*d*1 and 3*d*2 are rotationally driven in such a manner that the recording medium 2 is conveyed to the image forming portion in synchronism with image formation. After image formation, the recording medium 2 is conveyed to a fixing means 5. After being passed through the 15 fixing means 5, the recording medium 2 is discharged into a delivery portion 6, through a reversing path, by a pair of intermediary discharge rollers 3*e*, and a pair of final discharge rollers 3*f*1 and 3*f*2. There are guiding members 3*g*, which are located between the adjacent two pairs of the rollers to guide the recording medium 2 as it is conveyed.

The sheet feeder tray 3*a* comprises an internal member 3*a*1 and an external member 3*a*2. When the sheet feeder tray 2 is not in use, the internal member 3*a*1 is stored within the external member 3*a*2 in such a manner that the external member 3*a*1 constitutes a part of the external shell of the apparatus main assembly 15.

As for the structure for feeding the recording medium 2 with the use of a sheet feeder cassette 3*h*, the bottom portion of the apparatus main assembly 15 is provided with a portion, or a space, into which a cassette 3*h* is installed. When the recording medium feeding method is not manual, a plurality of recording media 2 stored within the sheet feeder cassette 3*h* are fed out of the cassette one by one, starting from the top, by a pickup roller 3*i*, and are conveyed to the pair of registration rollers 3*d*1 and 3*d*2 by conveyer roller 3*j*. After being passed through the pair of registration rollers 3*d*1 and 3*d*2, the conveyance of the recording medium 2 is the same as that in the case of the manual feeding of the recording medium 2.

Transferring Means

The transferring means 4 is a means for transferring a toner image formed on the photosensitive drum 7 in the image forming portion onto the recording medium 2. The transferring means 4 in this embodiment comprises a transfer roller 4, which presses the recording medium 2 upon the photosensitive drum 7 of the installed process cartridge B, and as the electrical voltage opposite in polarity to the toner image formed on the photosensitive drum 7 is applied to the transfer roller 4, the toner image on the photosensitive drum 7 is transferred onto the recording medium 2.

Fixing Means

The fixing means 5 is a means for fixing to the recording medium 2, the toner image which has been transferred onto the recording medium 2 through the application of electrical voltage to the transfer roller 4. As shown in FIG. 6, the fixing means 5 comprises a driving roller 5*a*, which is rotationally driven, and a fixing roller 5 which contains a heat generating portion and follows the rotation of the driving roller 5*a* by being pressed upon the driving roller 5*a*. More specifically, as the recording medium 2 onto which a toner image has been transferred in the image forming portion is passed between the driving roller 5*a* and fixing roller 5*b*, pressure is applied to the recording medium 2 and toner image by the two rollers 5*a* and 5*b* while the heat generated by the fixing roller 5*b* is applied to the recording medium 2 and the toner image, so that the transferred toner image is fixed to the recording medium 2.

Process Cartridge

The process cartridge B is a cartridge which contains an electrophotographic photosensitive member and a minimum of one processing means. As for processing means, there are a charging means for charging the surface of the electrophotographic photosensitive member, a developing means for forming a toner image on the electrophotographic photosensitive member, a cleaning means for removing the toner particles remaining on the surface of the electrophotographic photosensitive member, and the like. It should be noted here that the process cartridge B may be a development cartridge which lacks the photosensitive drum 7 but has a developing means.

Referring to FIG. 7, the process cartridge B in this embodiment comprises the photosensitive drum 7, a charge roller 8 as a charging means, an exposing portion 9, a development roller 10 as a developer carrying member, and a cleaning means 11. The charge roller 8, exposing means 9, development roller 9, and cleaning means 11 are disposed around the photosensitive drum 7. These components, portions, and means are covered with a combination of a developing means housing 13 and a cleaning means housing 20, and are integrated with a toner container 12, that is, a developer storage container, so that they can be removably installed in the main assembly 15 of an image forming apparatus. The process cartridge B also comprises a stirring member 10*a* for sending the toner stored in the toner storing portion 12*b* of the toner container 12, to the development roller 10.

Referring to FIG. 6, as the cover 14 of the apparatus main assembly 15 is rotated upward about a hinge 14*a*, a pair of unillustrated guide rails are exposed, which are attached one for one to the inwardly facing surfaces of the left and right walls of the apparatus main assembly 15. The process cartridge B is inserted into the apparatus main assembly 15 by engaging the unillustrated left and right guide portions of the process cartridge B, with the above described guide rails. The guide portions of the process cartridge B are positioned so that their axial lines coincide with the axial line of the photosensitive drum 7. The position of the process cartridge B in the apparatus main assembly becomes fixed as the guide portions of the process cartridge B engage one for one in the end portions of the guide rails.

Automatic Sealing Member Opening Apparatus

Figure 8:
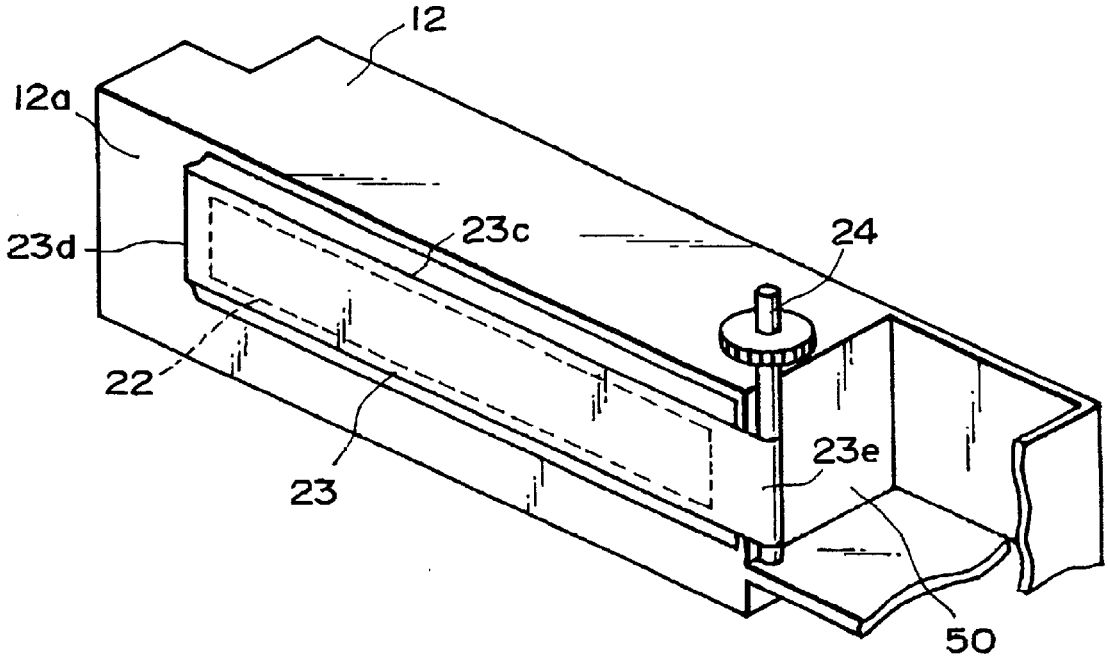
FIG. 8 is a perspective view of an automatic sealing member winding apparatus, which depicts the basic structure of the apparatus.

Next, the sealing member opening mechanism of the process cartridge B will be described based on the drawings. Referring to FIG. 8, the process cartridge B is provided with an opening 22, which is in the partitioning wall 12*a* between the toner container 12 and a development chamber 21 (FIG. 7), and through which developer is supplied. This opening 22 is sealed with a sealing member 23 which is thermally welded to the partitioning wall 12*a* by a method such as hot melt to keep the toner sealed within the toner container 12.

Figure 9:
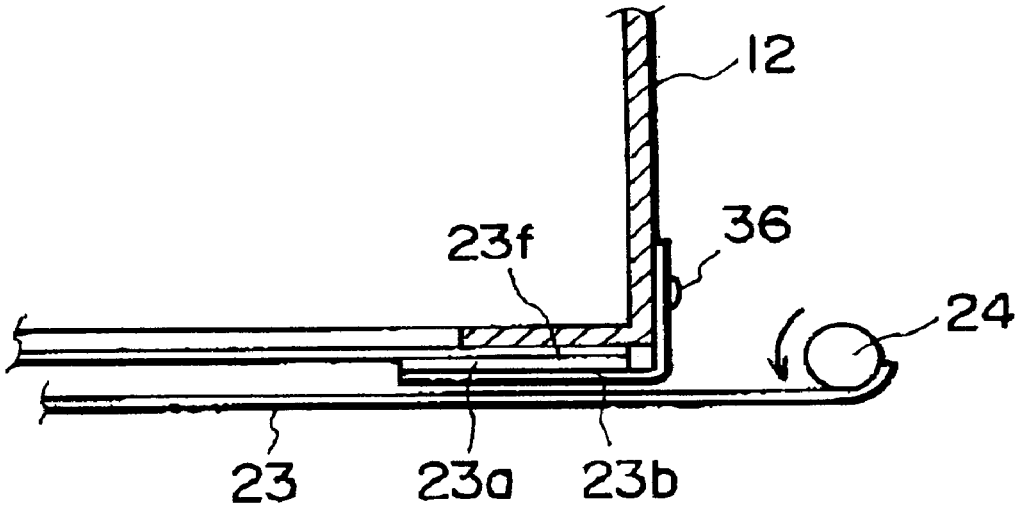
FIG. 9 is a sectional view of the winding shaft and its adjacencies, which shows the placement of the adhesive for preventing the sealing member from loosening after being completely wound into a roll.

Also referring to FIG. 8, the sealing member 23 is extended from the right side of the opening 22 to the left side of the opening 22, sealing the opening 22, with the sealing portions 23*c* with which the sealing member 23 is provided being pasted to the edges of the opening 22, and is folded back at a folding point 23*d* located on the left side of the opening 22, being extended rightward beyond the starting point of the sealing member 23. The end portion 23*e* of the portion of the sealing member 23 extended beyond the starting point is attached to a winding shaft 24. Next, referring to FIG. 9, the trailing end (right end) portion 23*f* of the sealing member 23 is coated with adhesive 23*a*. The top surface of the adhesive 23*a* is covered with a piece of paper 23 capable of easily separating from the adhesive, to prevent the trailing end portion 23*f* of the sealing member 23 from adhering to the other portions of the sealing member 23. The end portion of the separation paper 23*b*, which extends beyond the trailing end (right end) portion 23*f* of the sealing member 23, is fixed to the toner container 12 with the use of a fastener 36 or the like.

Figure 10:
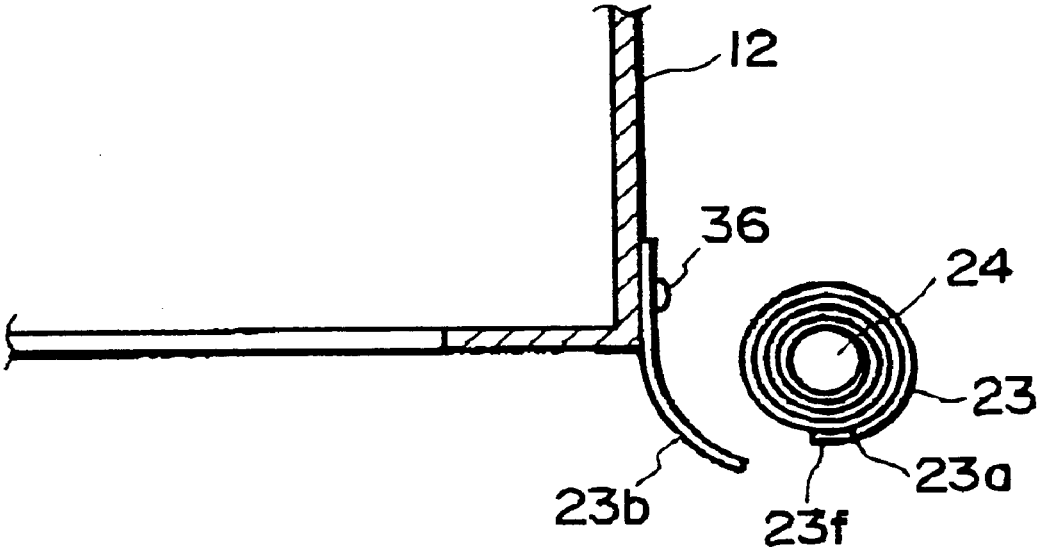
FIG. 10 is a sectional view of the winding shaft and its adjacencies, which shows the placement of the adhesive for preventing the sealing member from loosening after being completely wound into a roll.

After being wound, the sealing member 23 can remain wound around the winding shaft 24, as shown in FIG. 10, because of the presence of the adhesive 23*a* coated on the trailing portion 23*f* (the portion of the sealing member 23 wound last around the winding shaft 24).

As described above, in this embodiment, after the sealing member 23 is completely wound, the force for rotating only the winding shaft 24 is stopped to stop the rotation of the winding shaft 24, and/or to lock the winding shaft 24, so that odd noises are prevented from occurring, and also so that the toner particles adhering to the sealing member 23 are prevented from scattering. Referring to FIG. 8, the winding shaft 24 is disposed within a winding shaft storing portion 50 integrally formed with the toner container 12. The direction of the winding shaft 24 is parallel to the shorter edges of the opening 22. The winding shaft storing portion 50 is located next to the toner container 12 in terms of the longitudinal direction of the toner container, being separated from the toner storing portion 12*b* by a wall.

Figure 1:
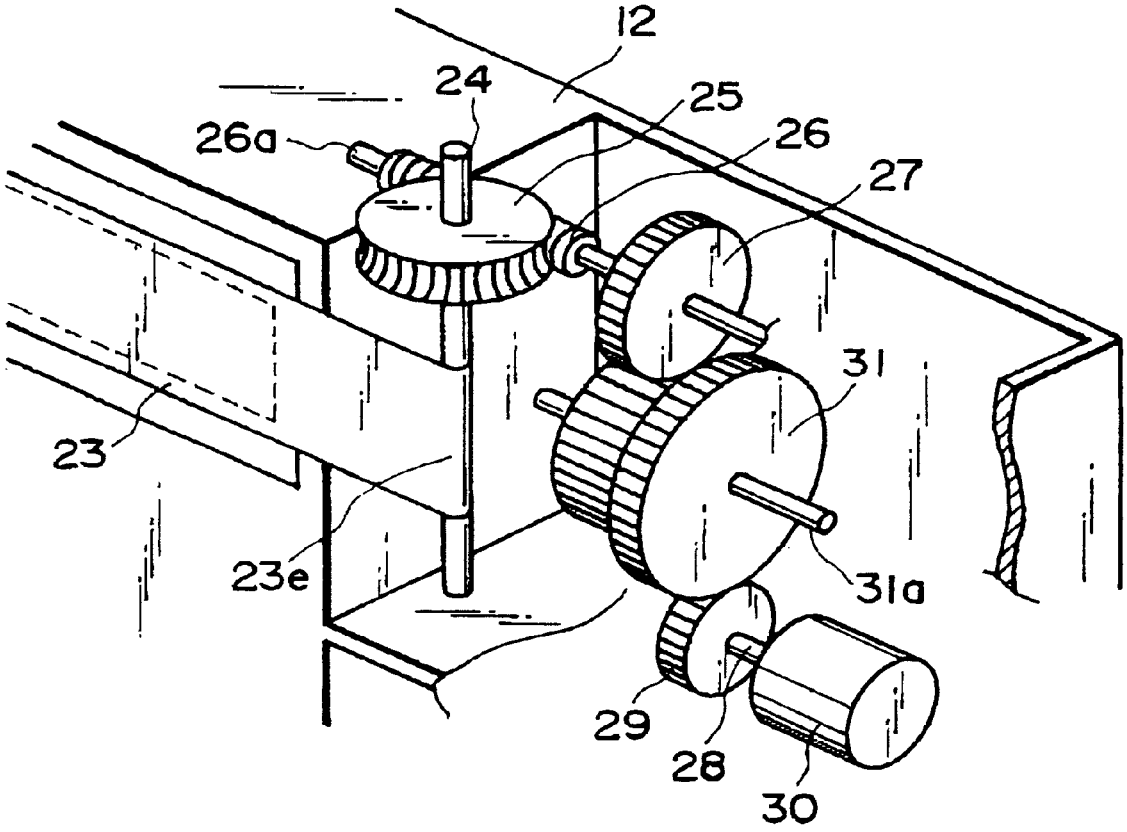
FIG. 1 is a perspective view of the portions of the cartridge and image forming apparatus in the primary embodiment of the present invention, in which the motor winds away the sealing member.

Next, the mechanism of the winding shaft portion in this embodiment of the present invention will be described. FIG. 1 shows the positioning of the gears of the winding shaft portion. The winding shaft 24 is rotationally supported by the toner container 12. To the winding shaft 24, the sealing member 23 is welded, and to the top end portion of the winding shaft 24, a winding gear 25 is fixed. This gear 25 is engaged with a worm gear fixed to a rotational shaft 26*a*. Thus, the direction of the axis of the torque for winding the sealing member 23 is changed from vertical, that is, the direction of the winding shaft 24, to horizontal, that is, the direction of the rotational shaft 26*a* The rotational shaft 26*a* is supported by the toner container 12 with the interposition of unillustrated bearings between the rotational shaft 26*a* and container 12. To this shaft 26*a* of the worm gear 26, a spur gear 27 is fixed. The spur gear 27 is indirectly engaged with a gear 29 of a power output shaft 28 of a motor 30, with the interposition of a stepped gear 31 between the spur gear 27 and the gear 29. The stepped gear 31 is rotationally engaged with a stationary shaft 31*a* fixed to the toner container 12. The train of these gears constitutes a velocity reduction mechanism for transmitting the rotation of the output shaft 38 of the motor 30 to the winding shaft 24 while reducing velocity. The torque of the motor 30 is amplified by this velocity reducing mechanism to provide the winding shaft 24 with a necessary amount of torque. The motor 30 is anchored within the process cartridge B with the use of an unillustrated means . This motor 30 is provided with an unillustrated harness through which electrical power is supplied to the motor 30 from an electrical power source on the side of the apparatus main assembly 15. It should be noted here that the motor 30, and the gear 29 fixed to the motor shaft 28, may be located on the side of the apparatus main assembly 15. In such a case, as the process cartridge B is inserted into the apparatus main assembly 15, the gear 31 of the process cartridge B engages with the gear 29 of the apparatus main assembly 29. In other words, the gears 29 and 31 constitute the connecting portions on the sides of the apparatus main assembly 15 and process cartridge B, respectively, which engage with each other as the process cartridge B is installed into the apparatus main assembly 15.

Figure 2:
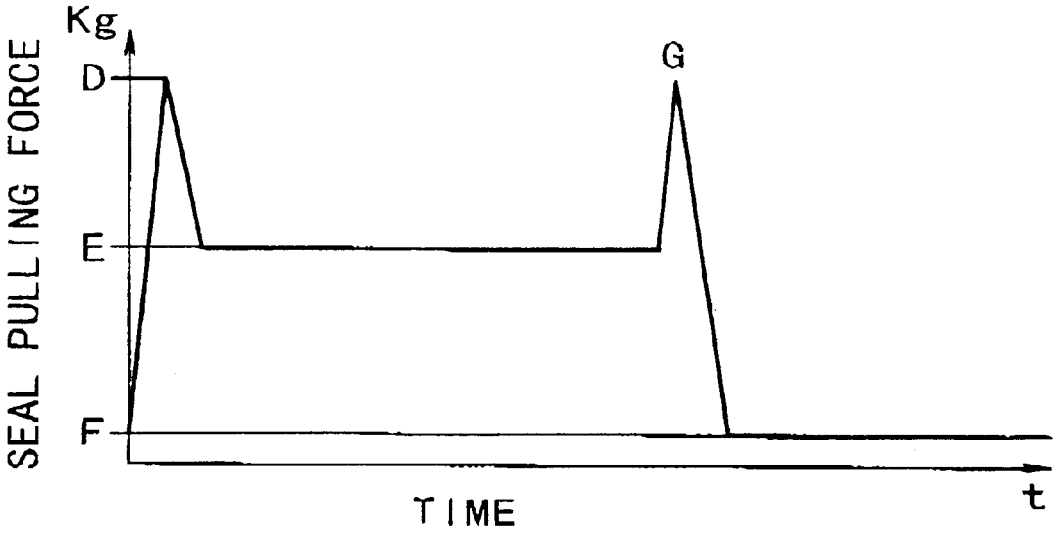
FIG. 2 is a graph which shows the change in the force necessary to peel away the sealing member.

The change in the amount of pulling force necessary to open the sealing member 23 is as follows. Referring to FIG. 2, the aforementioned amount of force reaches the first peak of D kg at the beginning of the peeling of the sealing member 23, and decreases to E kg, remaining there until it hits the second peak of G kg at almost the end of the peeling. After the second peak, the sealing member 23 is completely wound away around the winding shaft 24, the amount of the force decreasing to a force of F kg, which is equivalent to the amount of force necessary to rotate the winding shaft alone.

As is evident from the above description, the amount of the force necessary to peel away the sealing member 23 is relatively greater at the end portion of the sealing portion 23*c* compared to the center portion of the sealing portion 23*c*. Therefore, the sealing member winding shaft 24 needs to be strong enough to withstand both the peak amounts of the pulling force, and the motor 30 needs to generate torque high enough to provide the sealing member 23 with the peak amounts of the pulling force. In other words, the motor 30 is required to generate torque higher than the torque which generates the pulling forces of D kg and K kg, that is, the forces which apply to the end portion 23*f* of the sealing member 23 as shown in the drawing. Since the diameter of the roll of the portions of the sealing member 23 wound around the winding shaft 24 gradually increases as the sealing member 23 is wound up by the winding shaft 24, the amount of torque necessary for generating the pulling force of G kg sometimes becomes greater than that for generating the pulling force of D kg.

Figure 3:
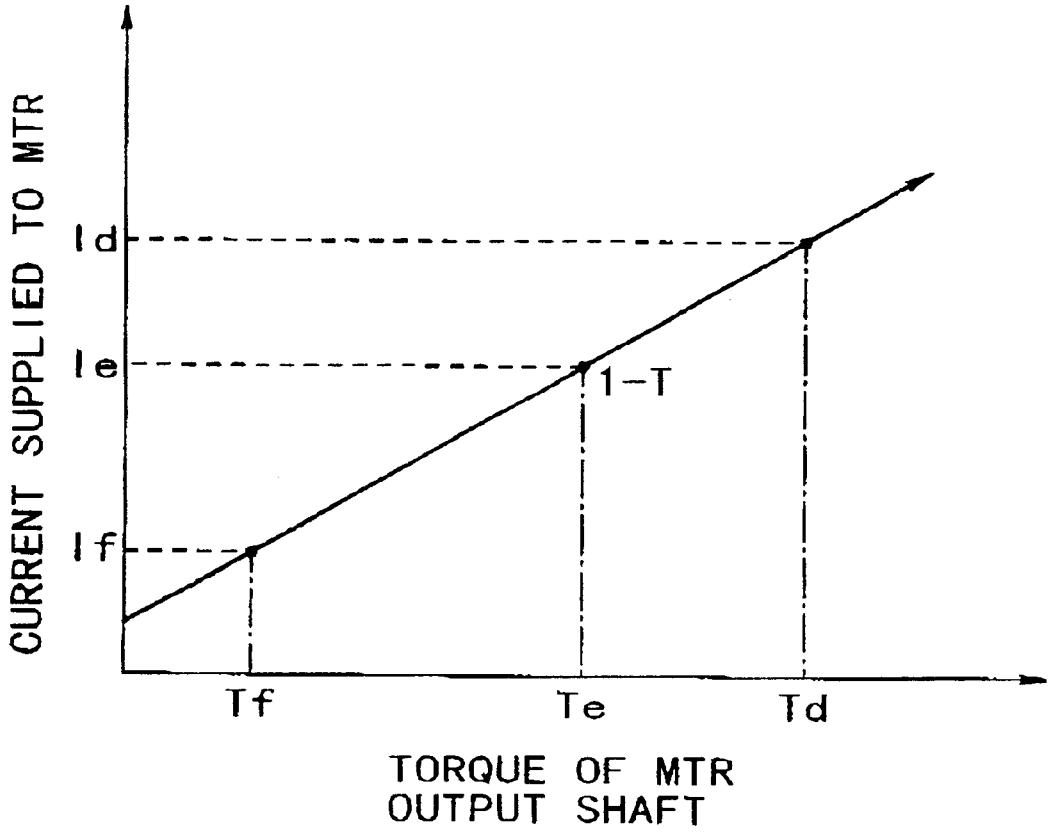
FIG. 3 is a graph which shows the change in the amount of the torque to be generated by the motor, and the change in the value of the current necessary for generating the torque.
Figure 4:
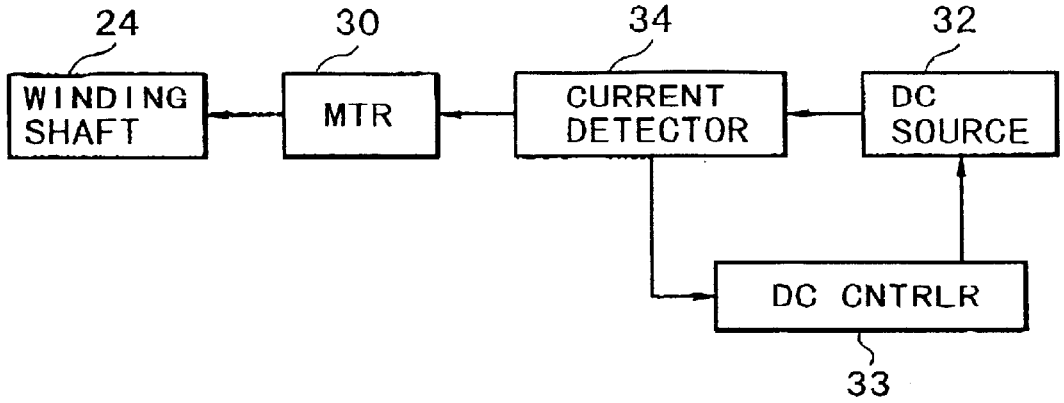
FIG. 4 is a block diagram of the structure for controlling the motor in the primary embodiment of the present invention.

The motor 30 used in this embodiment is a DC motor driven by electrical power, for example, a DC voltage of 5 V, supplied from the DC power source 32 illustrated in FIG. 4. As for the characteristics of this motor 30, the relationship between the amount of the torque outputted through the output shaft of the motor 30 and the value of the electrical current supplied to the motor 30 is linear as shown in FIG. 3. This linear relationship is peculiar to this type of motor; the motors of the same type display the same linear relationship. Therefore, if this data is inputted in advance into a DC controller 33, that is, a controlling means, of the apparatus main assembly 15, the value of the electrical current which flows through the motor 30. that is, the mechanical power source, can be determined based on the output from the current value detecting circuit 34 of the apparatus main assembly 15. For example, when the value of the current flowing through the motor 30 is Id, the amount of the torque outputted by the motor 30 through the output shaft is Td. This torque of Td is equivalent to the pulling force of D kg or G kg generated by the winding shaft 24, that is, the force necessary to be generated by the winding shaft 34 at the beginning or the end of the peeling of the sealing member 23. These values can be determined from the current values. During the period between the beginning and end of the peeling of the sealing member 23, a current of Ie is supplied to the motor 30 so that the motor generates a torque of Te, which is equivalent to the pulling force of E kg with which the sealing member 23 is pulled. When the current value is If, the output shaft of the motor 30 is provided with a toque of Tf by the motor 30. This is the state in which the smallest amount of pulling force of F kg is being generated. indicating that the sealing member peeling operation has completed, or the winding shaft 24 of the process cartridge B is being rotated after the completion of the peeling of the sealing member 23.

Next, the reason a system such as the one described above is necessary will be described.

The time necessary for the sealing member winding operation varies depending on the capacity of the motor 30. It is impractical to expect a small and inexpensive motor to generate high torque. In other words, usage of such a motor makes longer the time necessary for the actual sealing member winding operation. Thus, it is worth considering the employment of an element substantially exclusive or dedicated for determining whether or not the sealing member 23 has been wound into the process cartridge B. However, there is a concern that the employment of such an element adds to the costs of the apparatus main assembly 15 or process cartridge B, admitting that it makes an image forming apparatus easier to use. Further, if this winding operation is carried out, regardless of the presence or absence of the sealing member 23, each time power is applied to the image forming apparatus main assembly 15 the time from power application to image formation, that is, the waiting time, increases, substantially inconveniencing a user, since this time spent for rotating the winding shaft 23 is an absolute waste if the sealing member 23 has been already wound away. Therefore, an expensive and simple means has been sought.

Thus, in this embodiment of the present invention, a motor (30) dedicated for winding away the sealing member 23 is provided so that the motor (30), that is, the mechanical power source for driving the winding shaft 24, is not affected by the load from the development roller 10 and stirring member 10*a*. With this arrangement, it is assured that whether or not the sealing member pulling operation should be carried out after the insertion of the process cartridge B into the apparatus main assembly 15, can be determined from the value of the current flowing through the motor 30.

FIG. 4 is a drawing which shows the concept of the present invention. As is shown in FIG. 4, the electrical voltage supplied from the DC power source 32 is supplied to the motor 30 by way of the electric current detecting circuit 34. This electrical current detecting circuit 34 has a simple structure in that a resistive element (unillustrated) is placed as a part of the power supply route, and the voltage between the two ends of the resistive element is detected. The current value calculated from this voltage, that is, the resistance value of the resistive element, is constantly monitored and transmitted as information to the DC controller 33.

Based on this information, the DC controller 33 turns on or off the power from the DC power source 32 to the motor 30.

Figure 5:
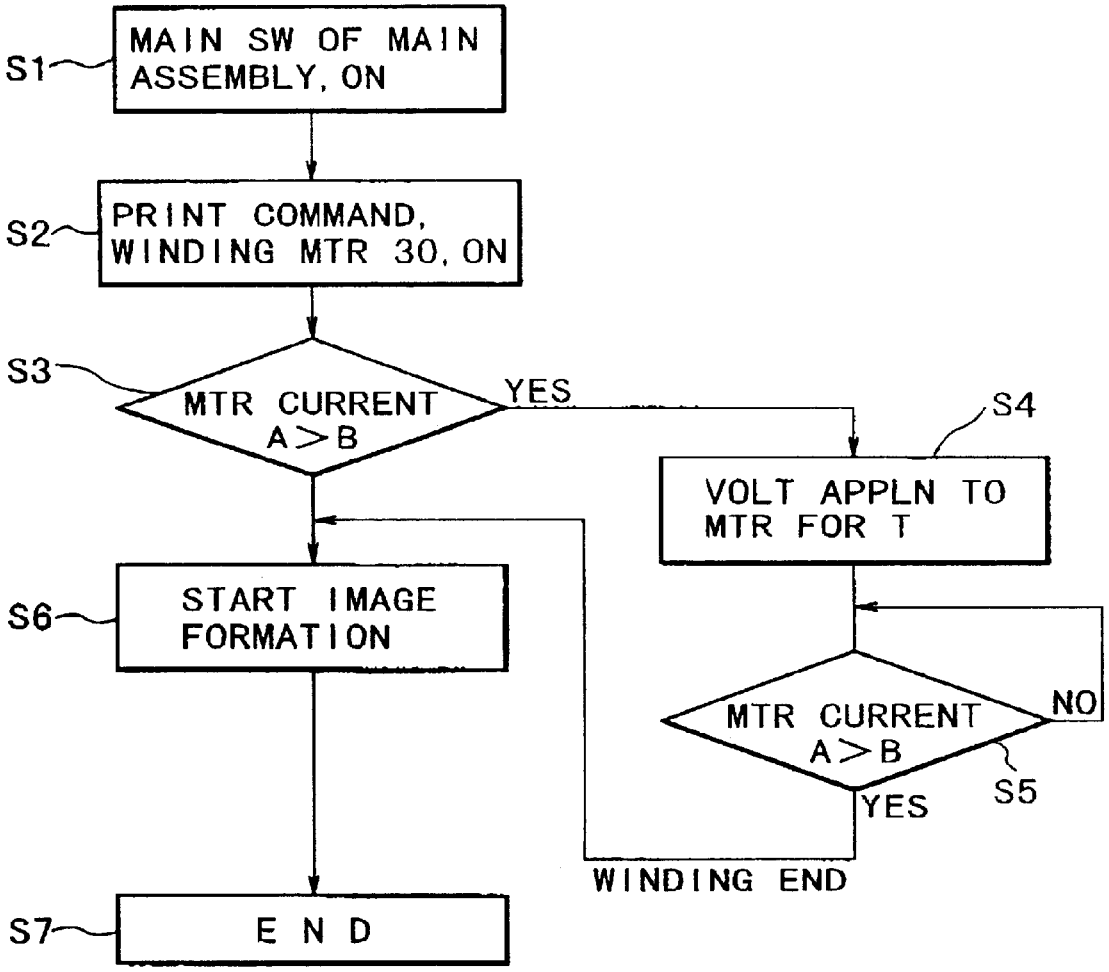
FIG. 5 is a flow chart which shows a sequence in which it is detected whether or not the sealing member of a process cartridge inserted into the main assembly of an image forming apparatus has been wound away, and a sequence in which the sealing member is peeled away.

Next, the actual operational sequence for this system will be described with reference to the flow chart given in FIG. 5.

First, the power source 32 of the image forming apparatus main assembly 15 is turned on (S1). As the power source 32 is turned on, image information is transmitted from the controller 33, a print start signal is sent. and a voltage of a predetermined level is applied only a brief moment after the power source is turned on (S2). The length of the period in which power is temporarily supplied to the motor 30 may be short, because this period is the period in which only the operation for measuring the load which applies to the motor 30 is carried out.

In this period, it is determined whether the value of the current flowing through the motor 30 is greater or smaller than a predetermined value (S3). When the current value is no smaller than the predetermined value, an unillustrated CPU of the apparatus main assembly 15 determines that the inserted process cartridge B is a brand-new process cartridge, that is, a process cartridge in which the sealing member 23 has not been peeled away, and applies voltage to the motor 30 for a predetermined length T of time (S4). This length T of time is approximately equal to the amount of time sufficient for completely peeling away the sealing member 23. After the elapse of this length T of time, the operational sequence repeats the step for measuring and comparing the current value (S5). When the current value is no greater than the predetermined value, the CPU determines that the operation for peeling away the sealing member 23 has been completed, and initiates an ordinary image forming operation (S6). During this step. fresh toner flows into the development chamber, and therefore, the developing means itself, instead of the winding shaft 23, idly rotates, sometimes until the amount of the toner within the development chamber reaches the proper level for image formation. When the current value flowing through the motor 30 measured the first time is no greater than the predetermined value, it is determined that the installed cartridge B is a process cartridge in which the sealing member 23 has been wound away, and the rotation of the motor 30 is instantly stopped, and an ordinary image forming operation is initiated (S6). After the image forming operation, the image forming apparatus main assembly is stopped (S7)

Additional Embodiments

In the above described embodiment of the present invention, the position to which the motor 30 is mounted may be either within the process cartridge B or within the image forming apparatus main assembly 15 as long as the positioning of the motor 30 does not create a problem regarding the transmission of driving force.

The advantage in placing the motor 30 in the process cartridge B is that the motor 30 and sealing member winding shaft 24 are connected to each other within the process cartridge B in terms of the force for driving the shaft 24, and therefore, the interface between the image forming apparatus main assembly 15 and process cartridge B becomes simple. In other words, all that needs attention when configuring the interface between the image forming apparatus main assembly 15 and the process cartridge B is the driving of the main components such as the photosensitive drum, development roller, and the like in the process cartridge B, which concern image formation, and the supplying of electrical signals and electrical voltage.

On the other hand, if the motor 30 is mounted on the image forming apparatus main assembly side, the same motor 30 remains even after the current process cartridge B is replaced with a new process cartridge B because of the expiration of the service life Thus, this arrangement is advantageous in terms of running cost.

The state of the sealing member 23 and the time when the sealing member 23 has been completely peeled away can be detected from the value of the current flowing through the motor 30 regardless of where the motor 30 is mounted.

Although FIG. 7 shows a process cartridge in accordance with the present invention, the present invention also applies to a development cartridge comprising a developer bearing member, a developer containing portion which stores the developer to be supplied to the developer bearing member, a sealing member for sealing the opening through which the developer within the developer containing portion is supplied to the developer bearing member, and an automatic sealing member winding apparatus, and it applies to an electrophotographic image forming apparatus in which such a development cartridge is detachably mountable.

In the preceding embodiments of the present invention, a motor was employed as the source for providing force for driving the winding shaft. However, a rotary actuator, a direct drive actuator, or the like may be employed in place of a motor.

While the invention has been described with reference to the structures disclosed herein, it is riot confined to the details set forth, and this application is intended to cover such modifications or changes as may come within the purposes of the improvements or the scope of the following claims.

What is claimed is:

1. A cartridge detachably mountable to a main assembly of an image forming apparatus, comprising:

a developing frame provided with an opening;

a developer carrying member in said opening to carry developer;

a developer containing portion for storing developer, said developer containing portion supplying developer to said developing frame through a developer supplying opening;

a sealing member for removably sealing said developer supplying opening; and a driving source substantially exclusive for providing the force for opening said sealing member, wherein when said cartridge is in the main assembly of an image forming apparatus, said driving source is controlled by controlling means provided in the main assembly of the image forming apparatus, wherein said controlling means turns on or off said driving source in response to electrical current which flows through said driving source and is detected by a detecting means provided in the main assembly of an image forming apparatus.

2. A cartridge according to claim 1, comprising a winding shaft for winding said sealing member, wherein said driving source provides said winding shaft with the winding force.

3. A cartridge according to claim 1, wherein said driving source is a DC motor.

4. A cartridge according to claim 1, wherein when said electrical current is no smaller than a predetermined value, said driving source is controlled in a manner to start an operation for opening said sealing member, whereas when said electrical current is no greater than a predetermined value, said driving source is turned off.

5. A cartridge according to claim 4, wherein after the starting of the operation for opening said sealing member, as the electrical current decreases below the predetermined value, said driving source is turned off.

6. A cartridge according to claim 1, further comprising an image bearing member to which developer is supplied by said developer carrying member.

7. A cartridge according to claim 6, wherein said image bearing member is an electrophotographic photosensitive member.

8. An image forming apparatus comprising:

a portion, or a space, provided in a main assembly of the image forming apparatus to removably accommodate a cartridge comprising: a developing frame provided with an opening; a developer carrying member in said opening to carry developer; a developer containing portion for storing developer, said developer containing portion supplying developer to said developing frame through a developer supplying opening; a sealing member for removably sealing said developer supplying opening; and a driving source substantially exclusive for providing the force for opening said sealing member;

detecting means for detecting the electric current flowing through said driving source;

controlling means for controlling said driving source in response to said electrical current.

9. An image forming apparatus according to claim 8, wherein said cartridge comprises a winding shaft for winding said sealing member, and said driving source provides said winding shaft with the winding force.

10. An image forming apparatus according to claim 8, wherein said driving source is a DC motor.

11. An image forming apparatus according to claim 8, wherein when said cartridge is in the main assembly of an image forming apparatus, said driving source is controlled by a controlling means provided in the main assembly of the image forming apparatus.

12. An image forming apparatus according to claim 11, wherein said controlling means turns on or off said driving source in response to said electrical current.

13. An image forming apparatus according to claim 12, wherein when said electrical current is no smaller than a predetermined value, said driving source is controlled in a manner to start an operation for opening said sealing member, whereas when said electrical current is no greater than a predetermined value, said driving source is turned off.

14. An image forming apparatus according to claim 13, wherein after the starting of the operation for opening said sealing member, as the electrical current decreases below the predetermined value, said driving source is turned off.

15. An image forming apparatus according to claim 8, wherein said cartridge comprises an image bearing member to which developer is supplied by said developer carrying member.

16. An image forming apparatus according to claim 15, wherein said image bearing member is an electrophotographic photosensitive member.

17. An image forming apparatus comprising:

a portion, or a space, provided in a main assembly of the image forming apparatus to removably accommodate a cartridge comprising: a developing frame provided with an opening; a developer carrying member in said opening to carry developer; a developer containing portion for storing developer, said developer containing portion supplying developer to said developing frame through a developer supplying opening: and a sealing member for removably sealing said developer supplying opening;

a driving source substantially exclusive for providing the force for opening said sealing member;

detecting means for detecting the electric current flowing through said driving source; and controlling means for controlling said driving source in response to said electrical current.

18. A developer container for storing developer, detachably mountable to a main assembly of an image forming apparatus, comprising:

a developer supplying opening for supplying developer into a developing frame housing;

a sealing member for removably sealing said developer supplying opening; and a driving source substantially exclusive for providing the force for opening said sealing member, wherein when said developer container is in the main assembly of an image forming apparatus, said driving source is controlled by a controlling means provided in the main assembly of the image forming apparatus, wherein said controlling means turns on or off said driving source in response to electrical current which flows through said driving source and is detected by a detecting means provided in the main assembly of an image forming apparatus.

19. A cartridge according to claim 18, wherein when said electrical current is no smaller than a predetermined value, said driving source is controlled in a manner to start an operation for opening said sealing ember, whereas when said electrical current is no greater than a predetermined value, said driving source is turned off.

20. A cartridge according to claim 5, wherein after the starting of the operation for opening said sealing member, as the electrical current decreases below the predetermined value, said driving source is turned off.

21. A cartridge detachably mountable to a main assembly of an image forming apparatus, comprising:

a developing frame provided with an opening;

a developer carrying member in said opening to carry developer;

a developer containing portion for storing developer, said developer containing portion supplying developer to said developing frame through a developer supplying opening;

a sealing member for removably sealing said developer supplying opening; and a driving source substantially exclusively for providing the force for opening said sealing member, wherein the main assembly of an image forming apparatus is provided with detecting means for detecting information relating to torque of said driving source, and an operation of said driving source is controlled in accordance with the information.

22. A developer container for storing developer, detachably mountable to a main assembly of an image forming apparatus, comprising:

a developer supplying opening for supplying developer into a developing frame housing;

a sealing member for removably sealing said developer supplying opening; and a driving source substantially exclusively for providing the force for opening said sealing member, wherein the main assembly of an image forming apparatus is provided with detecting means for detecting information relating to torque of said driving source, and an operation of said driving source is controlled in accordance with the information.

* * * * *

UNITED STATES PATENT AND TRADEMARK OFFICE

CERTIFICATE OF CORRECTION

PATENT NO. : 6,516,168 B2
DATED : February 4, 2003
INVENTOR(S) : Tatsuya Shiratori et al.

It is certified that error appears in the above-identified patent and that said Letters Patent is hereby corrected as shown below:

Column 1,
Line 23, “a such” should read -- such --.
Line 57, “developing-means” should read -- developing means --.

Column 7,
Line 30, “means .” should read -- means. --.

Column 8,
Line 58, “assembly 15” should read -- assembly 15, --.

Column 10,
Line 22, “life” should read -- life. --.
Line 46, “riot” should read -- not --.

Column 12,
Line 47, “ember,” should read -- member, --.

Signed and Sealed this

Eleventh Day of November, 2003

JAMES E. ROGAN
*Director of the United States Patent and Trademark Office*